United States Patent [19]

Speed

[11] Patent Number: 4,742,753

[45] Date of Patent: May 10, 1988

[54] DRUMHEAD WITH FRAMED APERTURE

[76] Inventor: Zay Speed, 4412 Beechwood Rd., Salt Lake City, Utah 84123

[21] Appl. No.: 106,173

[22] Filed: Oct. 7, 1987

[51] Int. Cl.[4] ..... G10D 13/02

[52] U.S. Cl. ..... 84/414; 84/411 R

[58] Field of Search ..... 84/411–417, 84/420

[56] References Cited

U.S. PATENT DOCUMENTS

| | | | |
|---|---|---|---|
| 362,099 | 5/1887 | Maloney | 84/411 R |
| 3,026,759 | 3/1962 | Kleiner et al. | 84/411 R |
| 4,214,504 | 7/1980 | Rex | 84/411 R |

*Primary Examiner*—Lawrence R. Franklin

[57] ABSTRACT

The flexible diaphragm sheet of a drumhead of a drum as a musical instrument is apertured in a manner often done by drummers to enhance the sound emitted by the drum, but, in accordance with the invention, the aperture is rigidly framed about its defining margin to substantially reestablish the vibration integrity of the diaphragm and to protect it against splitting and cracking. Framing may be accomplished integrally with the diaphragm sheet in drum fabrication originally, or may be accomplished by securely clamping a frame in place about the defining margin of the aperture in existing drumheads or during fabrication of drumheads.

18 Claims, 2 Drawing Sheets

DRUMHEAD WITH FRAMED APERTURE

BACKGROUND OF THE INVENTION

1. Field

The invention has to do with tensioned flexible heads of drums of all kinds as musical instruments.

2. State of the Art

Drums as musical instruments are normally made with flexible heads of various sheet materials, usually a plastic such as a Mylar, arranged to be tensioned after installation on the hollow body of the drum. As customarily produced, such drumheads may be single sheets, or they may be double sheets with a liquid therebetween.

It has been the practice with some drummers to cut a circular aperture in the flexible diaphragm sheet of a single sheet drumhead for the purpose of releasing air lock and sonic charge within the hollow interior of the drum to augment and beneficially modify sound characteristics, but this has had a tendency to distort vibration of such sheet and to result in relative short life for the drumhead by reason of splitting and cracking of the sheet marginally of the aperture.

BRIEF SUMMARY OF THE INVENTION

For remedying the problems associated with the practice of aperturing drumhead diaphragm sheets and for obtaining true musical tones along with all the values sought by such practice, it is a primary feature of the invention that the aperture be substantially rigidly framed marginally. This also enables double sheet drumheads to be apertured, without loss of the liquid inserted between the sheets or with vibration of the individual sheets relative to one another which would produce extraneous sounds.

An advantageous way of carrying out the invention, especially for the drumhead diaphragm of an existing drum, is by applying an annular clamp to the margin of the drumhead sheet or sheets which define the aperture. Tightening of the upper and lower annular sections of the clamp, which in some forms of the invention are joined by screw threading for clamping purposes, protects the sheet margin or margins and largely restores the vibrational integration of the sheet or sheets. However, the sheet or sheets may have framing molded integrally therewith about aperturing provided during manufacture of the sheet or sheets, or framing members may be secured by adhesive, such as a strong glue, to opposite faces of the sheet or sheets marginal to the aperture or to one or the other of the opposite faces there of.

A related design application, Ser. No. 066,103, filed June 24, 1987, jointly by myself, as Jeffrey Brain Howcroft, and by Isaac Levi Alldredg is concerned strictly with ornamental design for the mechanical arrangement invented solely by me as here disclosed.

THE DRAWINGS

Figure 1:
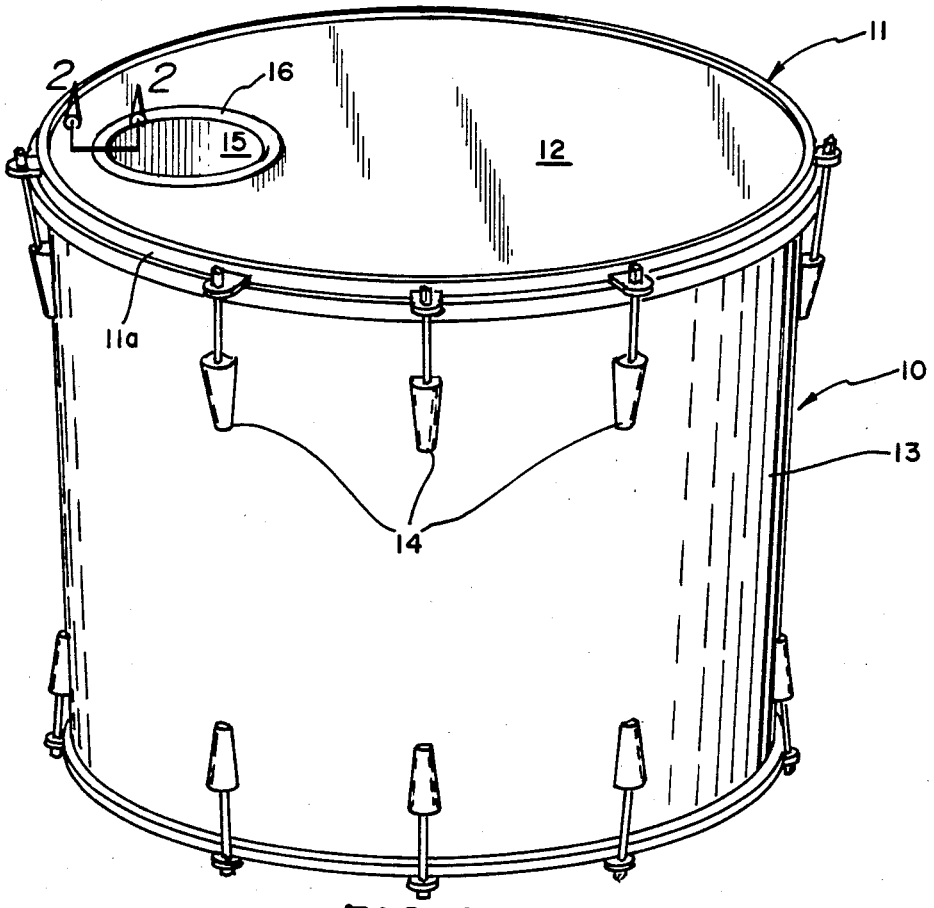
Figure 2:
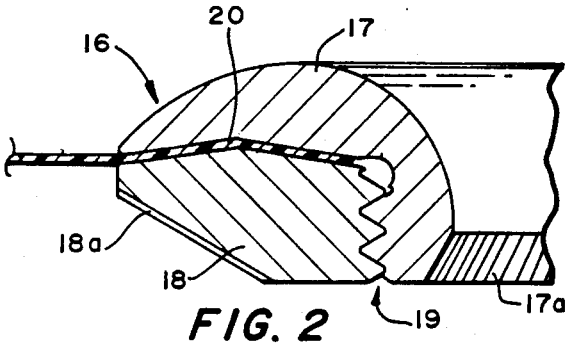
Figure 3:
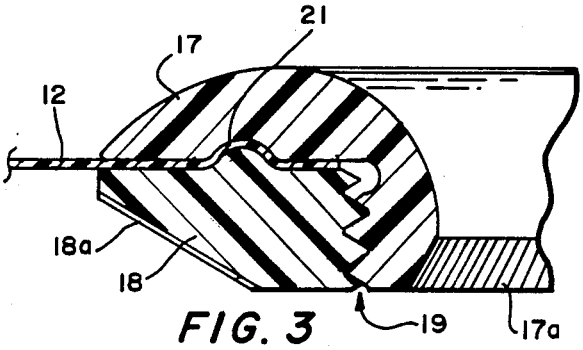
Figure 4:
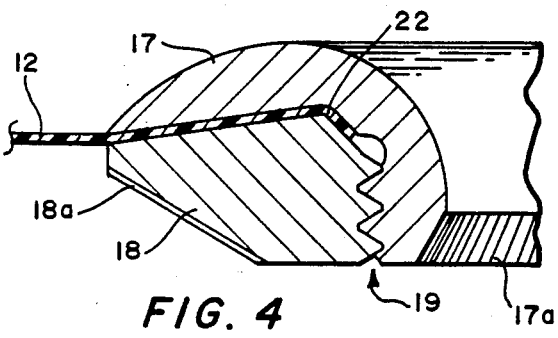
Figure 5:
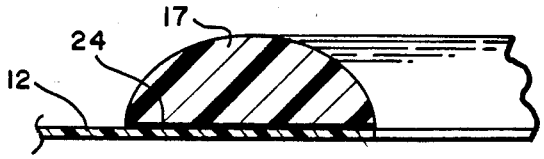
Figure 6:
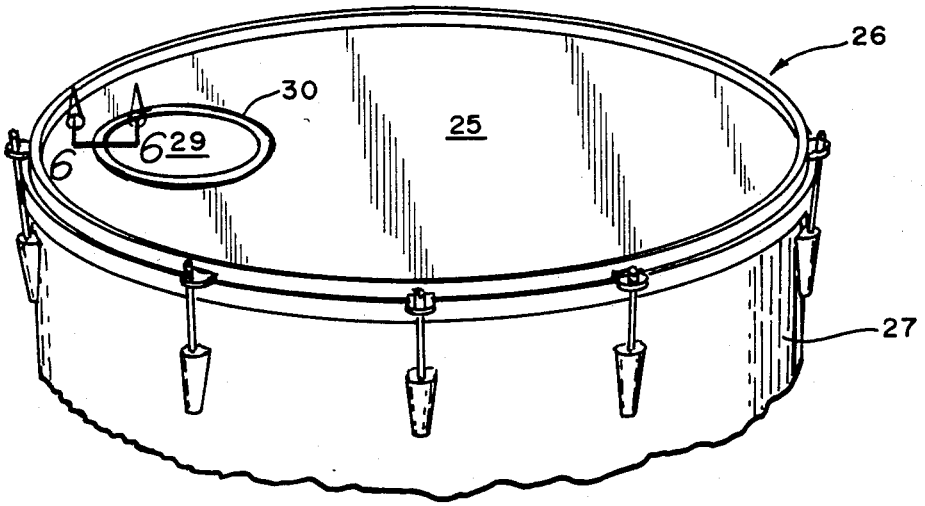
Figure 7:
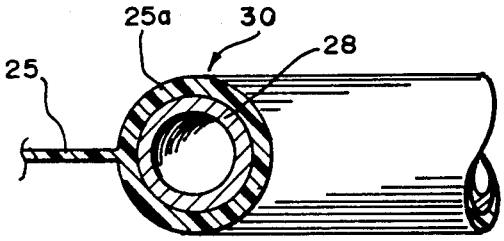
Figure 8:
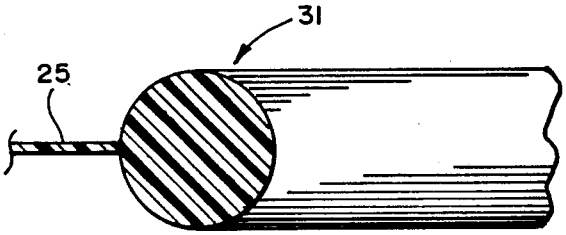
Figure 9:
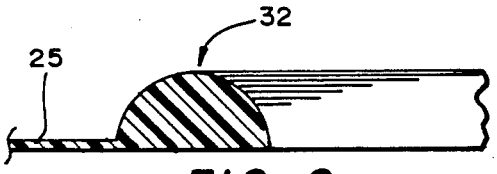
Figure 10:
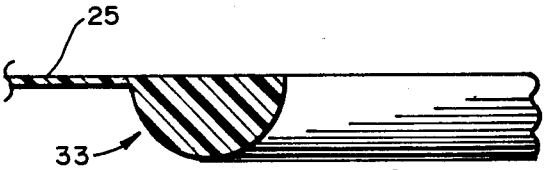
Figure 11:
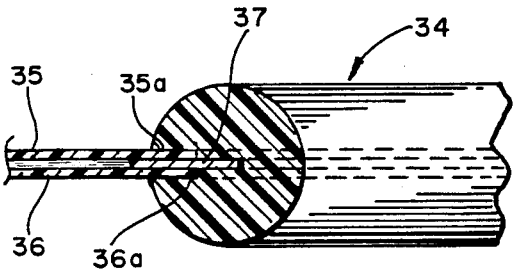
Figure 12:
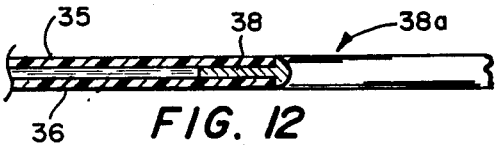
Figure 13:
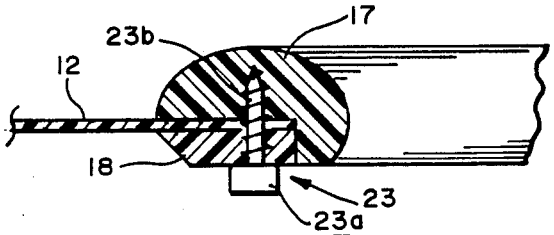

The best modes presently contemplated for carrying out the invention in practice are shown in the accompanying drawings in which:

FIG. 1 is a view in perspective of a typical musical drum having a diaphragm single sheet drumhead with circular aperture framed by a screw clamp;

FIG. 2, a transverse section taken on the line 2—2 of FIG. 1, through one side of the clamp, the view being considerably enlarged and showing drum head portions broken off at both sides;

FIGS. 3 and 4, views similar to that of FIG. 2, but with alternative, confronting, sheet clamping faces, respectively;

FIG. 5, another similar view but showing a single ring glued to the top face of the drum head sheet;

FIG. 6, a fragmentary view corresponding to the upper portion of FIG. 1, but with integral marginal enlargement molded about a metal ring;

FIG. 7, a view similar to that of FIG. 2 but taken on the line 7—7 of FIG. 6;

FIGS. 8–10, similar views showing alternative forms, respectively, of integrally molded margin, without metal insert;

FIGS. 11 and 12, similar views showing alternate forms, respectively, of double diaphragm sheet drumhead according to the invention; and FIG. 13, a view similar to that of FIG. 2 but showing still another alternative form of the invention.

DETAIL DESCRIPTION OF THE ILLUSTRATED EMBODIMENTS

In the form of the invention illustrated in FIG. 1, a musical instrument drum 10 has a drumhead 11 of flexible sheet drumhead material 12, such as the plastic sheet material known as "Mylar", a polyester film characterized by high tensil strength, from which most drumheads are now made. Drumhead 11 is attached to the hollow cylindrical body 13 of drum 10 in customary manner for stretching taut by means of usual tensioning elements 14.

Sheet drumhead material 12 is cut or molded to provide a relatively minor aperture 15 therein at a strategic location for the purposes for which such apertures have been used in the past, here shown in FIG. 1 as being close to the retaining ring 11*a* of the drumhead.

In accordance with the invention, the aperture 15 is framed about its periphery substantially rigidly relative to the drumhead sheet or sheets to, in effect, restabilize the integrity of such sheet or sheets. Since in this illustrated instance, and as it usually will be, aperture 15 is circular, the aperture framing is of annular configuration, and, if for existing drums altered in accordance with the invention the frame will be of clamp formation.

As illustrated in FIGS. 1 and 2, frame 16 is made up of two annular, mating, substantially rigid ring parts or sections, an upper ring 17 and a lower ring 18 matingly screw threaded as at 19 for tight clamping to received margins of sheet material 12 which define aperture 15. Rings 17 and 18 are rigid and made of any suitable material, such as metal or even wood. However, it is preferred to make such rings of a strong and rigid plastic material, such as polyethelene, as indicated in the alternative forms shown in FIGS. 3–5 and 13 where like parts are indicated by like reference numbers.

The confronting clamping faces of the clamping rings may be entirely flat, as in FIG. 13, or may be variously matingly ribbed, as in FIGS. 2–4 at 20, 21, and 22, respectively. For simplifying installation, knurling 17*a* and 18*a* may be provided as illustrated on lower surfaces of screw clamping rings 17 and 18, respectively.

It is presently preferred, for the sake of economy in manufacture, to construct the framing clamp as in FIG. 13, wherein the two clamping rings 17 and 18 are clamped together upon drumhead sheet 12 by means of screws 23, which desirably have standard drum key heads 23*a* and shanks 23*b* with sheet metal screw threading. Four of the screws 23, evenly spaced about rings 17 and 18, are usually adequate but more may be employed. The rings are injected molded with slightly undersize screw-receiving holes.

FIG. 5 shows how a single framing ring, here indicated 17, may be applied flatwise to the drumhead sheet surface marginally of the aperture and secured thereto by a firm setting adhesive, such as a glue, indicated at 24.

The aperture framing may be integral with the drumhead sheet. As shown in FIGS. 6 and 7, flexible drumhead sheet 25 of Mylar plastic in drumhead 26 on drum body 27 is molded at 25*a* about a rigid annular core 28 marginally of aperture 29 to provide framing 30 for such aperture. Such core is preferably of hollow tubular formation, and may be of metal or of a plastic material.

As shown in FIGS. 8–10, the aperture framing may be wholly integral with the drumhead sheet. In FIG. 8, framing 31 is wholly integral with drumhead sheet 25. In FIG. 9, framing 32 is also wholly integral with drumhead sheet 25, but encompasses the aperture margin only on the upper face of the sheet, while in FIG. 10 similar framing 33 encompasses the aperture margin only on the lower face of the sheet.

As applied to an aperture in double sheets of a double sheet drumhead, framing clamps corresponding to those shown in FIGS. 1–4 and 13 may be used, or, as shown in FIG. 11, a frame 34 may be molded of any suitable material, such as a plastic, about the aperture-defining margins 35*a* and 36*a* of the apertured sheets 35 and 36 and about a sealing insert ring 37 between the sheets. In FIG. 12, a sealing insert ring 38 of generally T-shape in transverse cross-section is sealed between and to the sheet 35 and 36 by films of adhesive (not shown), the cross-head 38*a* of such ring insert being preferably rounded, as shown, and projecting into the aperture.

If apertures are used and variously located in the sheet or sheets of both of the opposite drumheads, respectively, of a drum, they are each framed in one or another of the several alternative forms of the invention proviously described. Except for screw type clamping frames, shapes of the apertures and of corresponding framing in accordance with the invention may vary considerably, being either regular or irregular in their peripheries, such as eliptical, square, polygonal, or rain drop shape, etc.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A drumhead for a drum as a musical instrument, comprising a sheet of flexible drumhead material adapted to be stretched taut in a drumhead tensioning ring as a sound emitting diaphragm; a drumhead tensioning ring in which said sheet is mounted for tensioning; an aperture in said sheet; and a frame secured to said sheet marginally of and surrounding said aperture, said frame being substantially rigid relative to said sheet for substantially reestablishing the integrity of the apertured sheet.

2. A drumhead according to claim 1, wherein the frame is a clamp closed peripherally and having upper and lower clamping sections with confronting clamping faces clamped to the defining margins of the aperture.

3. A drumhead according to claim 2, wherein the clamp is annular and has upper and lower, mating, ring sections screw threaded for clamping together, upon the margins of the sheet that define the aperture.

4. A drumhead according to claim 2, wherein the confronting clamping faces of the clamp sections are planar in extent.

5. A drumhead according to claim 2, wherein the clamping faces are matingly ribbed peripherally of the frame.

6. A drumhead according to claim 2, wherein the clamping sections of the clamp are made of a plastic material.

7. A drumhead according to claim 2, wherein the clamping sections of the clamp are made of metal.

8. A drumhead according to claim 2, wherein the upper and lower clamping sections are clamped together by screws threaded thereinto.

9. A drumhead according to claim 1, wherein the frame comprises a peripheral frame member adhesively secured to a face of the drumhead sheet.

10. A drumhead according to claim 1, wherein the frame is at least partially of the same material as the drumhead sheet and is formed integrally therewith.

11. A drumhead according to claim 10, wherein the frame comprises a substantially rigid core extending continuously therearound, and a covering of the same material as, and integral with, the drumhead sheet.

12. A drumhead according to claim 10, wherein the rigid frame is formed entirely of the same materials as, and is entirely integral with, the drumhead sheet.

13. A drumhead according to claim 1, comprising double sheets similarly apertured in registery and having the defining margins of the apertures sealingly fastened together by the frame.

14. A drum musical instrument, having a drumhead in accordance with claim 1.

15. A drumhead according to claim 1, wherein the flexible sheet is a polyester film characterized by high tensile strength.

16. A drumhead sheet as a sound emitting diaphragm for musical instrument drums, comprising a flexible sheet of drumhead material having an aperture therein; and a frame secured to said sheet marginally of and surrounding said aperture, said frame being substantially rigid relative to said sheet for substantially reestablishing the integrity of the apertured sheet.

17. A drumhead sheet according to claim 16, wherein the flexible sheet is a polyester film characterized by high tensile strength.

18. A method of modifying the sound of a drum provided with a drumhead, comprising the steps of:

forming an aperture in said drumhead; and affixing a rigid frame marginally of the aperture leaving said aperture open to the interior of the drum.

* * * * *